US005969735A

United States Patent [19]

Haigo

[11] Patent Number: 5,969,735

[45] Date of Patent: Oct. 19, 1999

[54] MAILING MACHINE INCLUDING AN INK JET PRINTER HAVING BACK PRESSURE REGULATION

[75] Inventor: Hideaki Haigo, Nagoya, Japan

[73] Assignee: Pitney Bowes Inc., Stamford, Conn.

[21] Appl. No.: 09/059,175

[22] Filed: Apr. 13, 1998

[51] Int. Cl.[6] ..... B41J 2/175

[52] U.S. Cl. ..... 347/85

[58] Field of Search ..... 347/85, 86, 87, 347/37, 4, 7; 364/468.02, 468.03; 400/328.1, 326, 120.16, 120.17

[56] References Cited

U.S. PATENT DOCUMENTS 5,467,709 11/1995 Salomon ..... 101/93
5,485,187 1/1996 Okamura et al. ..... 347/85
5,806,994 9/1998 Coffy et al. ..... 400/120.01
5,818,484 10/1998 Lee et al. ..... 347/86

*Primary Examiner*—N. Le
*Assistant Examiner*—Michael Nghiem
*Attorney, Agent, or Firm*—Angelo N. Chaclas; Melvin J. Scolnick

[57] ABSTRACT

An ink jet printing system includes a print head, a reservoir of ink and a device for adjusting the level of ink in the reservoir. The print head is translatable between a first print position having a first elevation and a second print position having a second elevation. The reservoir is operatively coupled with the print head for supplying ink to the print head and is remotely located from the print head. The adjusting device regulates the ink level depending upon the position of the print head so that a predetermined back pressure is maintained at the print head in both the first print position and the second print position.

6 Claims, 3 Drawing Sheets

MAILING MACHINE INCLUDING AN INK JET PRINTER HAVING BACK PRESSURE REGULATION

FIELD OF THE INVENTION

This invention relates to an ink jet printer including a print head, an ink supply remotely located from the print head and a system for maintaining a desired back pressure at the print head. More particularly, this invention is directed to a mailing machine including the ink jet printer for printing at a first print position having a first elevation and for printing at a second print position having a second elevation where the back pressure at the print head is maintained at the desired back pressure between the two print positions.

BACKGROUND OF THE INVENTION

Ink jet printers are well known in the art. Generally, an ink jet printer includes an array of nozzles or orifices, a supply of ink, a plurality of thin channels connecting the array of nozzles with the ink supply, respectively, a plurality of ejection elements (typically either expanding vapor bubble elements or piezoelectric transducer elements) corresponding to the array of nozzles and suitable driver electronics for controlling the ejection elements. Typically, the array of nozzles and the ejection elements along with their associated components are referred to as a print head. It is the activation of the ejection elements that causes drops of ink to be expelled from the nozzles. The ink ejected in this manner forms drops which travel along a flight path until they reach a print medium such as a sheet of paper, overhead transparency, envelope or the like. Once they reach the print medium, the drops dry and collectively form a print image. Typically, the ejection elements are selectively activated or energized as relative movement is provided between the print head and the print medium so that a predetermined or desired print image is achieved.

Generally, there are two methods available for integrating the print head and the ink supply. A widely adopted method combines the following into a disposable cartridge: the print head, ink supply, ink delivery system and a contact pad for receiving control signals from the ink jet printer. In this manner, a fresh cartridge may be installed when the ink supply of the current cartridge has been consumed. On the other hand, the print head and the ink supply may be located remotely from each other.

To keep an ink jet printer in proper working order, it is necessary to control the pressure at which ink is delivered from the supply to the print head. If the pressure is too high, then there is a risk that ink will leak out of the print head. On the other hand, if the pressure is too low, then there is a risk that the capillary forces on the ink in the ink channels may not be sufficient to draw ink down from the supply. Therefore, it is desirable to maintain the pressure at the print head (commonly referred to as back pressure) within a predetermined range. In most ink jet printers the back pressure is set just below atmospheric pressure. Since back pressure also influences ink drop size, maintaining the back pressure within a narrow predetermined range has the added benefit of producing individual ink drops of uniform size. This also directly contributes to increased print quality.

Recently, the postage meter industry and other envelope printing industries have begun to incorporate ink jet printers. A typical postage meter (one example of a postage printing apparatus) applies evidence of postage, commonly referred to as a postal indicia, to an envelope or other mailpiece and accounts for the value of the postage dispensed. As is well known, postage meters include an ascending register, that stores a running total of all postage dispensed by the meter, and a descending register, that holds the remaining amount of postage credited to the meter and that is reduced by the amount of postage dispensed during a transaction.

Generally, the postage meter may be incorporated into a mailing machine, which is also well known in the art, for automated handling of the mailpieces. Mailing machines are readily available from manufacturers such as Pitney Bowes Inc. of Stamford, Conn. USA and often include a variety of different modules, which automate the processes of producing mailpieces. The typical mailing machine includes a variety of different modules or sub-systems where each module performs a different task on a mailpiece, such as: singulating (separating the mailpieces one at a time from a stack of mailpieces), weighing, sealing (wetting and closing the glued flap of an envelope), applying evidence of postage, accounting for postage used performed by the postage meter), feeding roll tape or cut tape strips for printing and stacking finished mailpieces. However, the exact configuration of each mailing machine is particular to the needs of the user. Customarily, the mailing machine also includes a transport apparatus, which feeds the mailpieces in a path of travel through the successive modules of the mailing machine.

In high volume mailing machines it is desirable to have separate mailpiece and tape feed paths. In this manner, the structure of the mailing machine may be optimized for the diverse requirements of feeding mailpieces and tape. That is, the transport apparatus includes an assembly best suited for feeding mailpieces and another assembly best suited for feeding tape. Examples of such mailing machines are described in U.S. Pat. Nos. 5,467,709 and 5,696,829. Also, to assist in registering the top edge of the mailpiece, the mailing machine often includes a feed deck that is inclined slightly from horizontal. In this manner, gravity assists by inducing the mailpieces to slide down the inclined feed deck until the top edge of the mailpiece abuts a substantially vertical registration wall.

Although such mailing machines work generally well, some drawbacks have been identified. In such high volume mailing machines it is possible to print large numbers of envelopes (180 to 240) per minute which leads to a very large number of envelopes printed on a daily basis. Thus, the rate of ink consumption is high. As a result, the ink cartridges do not provide an economical method of supplying ink and need to be replaced frequently by the operators. Furthermore, the disposable nature of the cartridges does not lend itself to cost effective operation because of the amount of material (print head, contact pad, ink delivery system, etc.) that is thrown away.

Therefore, there is a need for a postage printing apparatus, such as a mailing machine, that incorporates a large capacity ink supply, controls back pressure and is capable of printing in two positions, one for mailpieces and the other for tape.

SUMMARY OF THE INVENTION

The present invention provides an off print head ink delivery system and a device for regulating the level of ink within the ink delivery system so that a predetermined back pressure is maintained at the print head regardless of the print position.

In conventional fashion, this invention may be incorporated into a variety of devices employing ink jet printing, such as: a general purpose ink jet printer or a postage printing system (mailing machine, postage meter, or the like).

In accordance with the present invention, there is provided an ink jet printer including a print head, a reservoir of ink and a device for adjusting the level of ink in the reservoir. The print head is translatable between a first print position having a first elevation and a second print position having a second elevation. The reservoir is operatively coupled with the print head for supplying ink to the print head and is remotely located from the print head. The adjusting device regulates the ink level depending upon the position of the print head so that a predetermined back pressure is maintained at the print head in both the first print position and the second print position. A method of operating the ink jet printer is also provided.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENT

Figure 1:
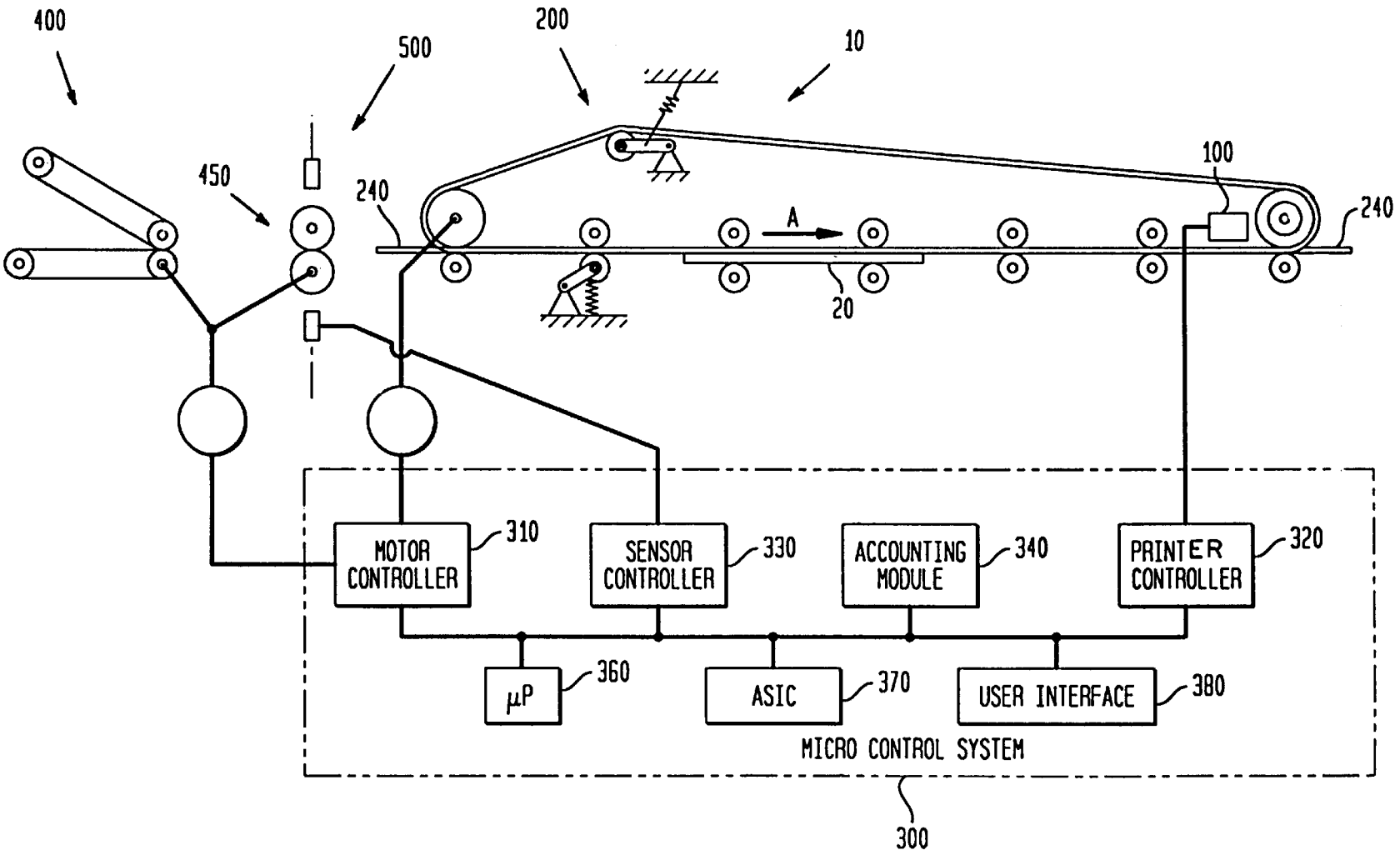
FIG. 1 is a simplified schematic of a front elevational view of a mailing machine which incorporates the present invention.

Referring to FIG. 1, a simplified schematic of an elevational view of a mailing machine 10 is shown. The mailing machine 10 includes a printer module 100, a conveyor apparatus 200, a micro control system 300, a singulator module 400, a pair of take-away rollers 450 and a sensor assembly 500 for detecting the presence of an envelope 20. Other modules of the mailing machine 10, such as those described above, have not been shown for the sake of clarity.

The singulator module 400 receives a stack of envelopes (not shown), or other mailpieces such as postcards, folders and the like, and separates and feeds them in a seriatim fashion (one at a time) in a path of travel as indicated by arrow A. The take-away rollers 450 feed envelope 20 past the sensor assembly 500 and delivers the envelope 20 to the conveyor apparatus 200 which in turn feeds the envelope 20 in the path of travel along a deck 240 past the printer module 100 so that a postal indicia can be printed on each envelope 20. Together, the singulator module 400, take-away rollers 450 and the conveyor module 200 make up a transport apparatus for feeding the envelopes 20 through the various modules of the mailing machine 10. The deck 240 is tilted about five degrees from horizontal so that gravity assists in aligning the top edge (not shown) of the envelope 20 with a registration wall (not shown). In this manner, the placement of the postal indicia in the upper right hand corner of the envelope 20 may be facilitated no matter what the dimensions of the envelope 20.

The sensor module 500, the singulator module 400, the conveyor apparatus 200 and the printer module 100 are under the control of the micro control system 300 which may be of any suitable combination of microprocessors, firmware and software. The micro control system 300 includes a motor controller 310, a printer controller 320 which is in operative communication with the printer module 100, a sensor controller 330 which is in operative communication with the sensor assembly 500; an accounting module 340 for authorizing and accounting for the dispensing of postal funds; a microprocessor 360; a security application specific integrated circuit (ASIC) 370 and a user interface 380. The motor controller 310, the printer controller 320, the sensor controller 330, the accounting module 340 and other various components of the micro control system 300 are all in operative communication with each other over suitable communication lines. Generally, the microprocessor 360 coordinates the operation and communications between the various sub-systems of the mailing machine 10.

A more detailed description of the sensor module 500, the singulator module 400 and the conveyor apparatus 200 may be found in U.S. patent application Ser. No. 08/773,149 entitled ARTICLE TRANSPORT APPARATUS, filed on Dec. 26, 1996 and assigned to the assignee of the present invention, the disclosure of which is specifically incorporated herein by reference.

Figure 2:
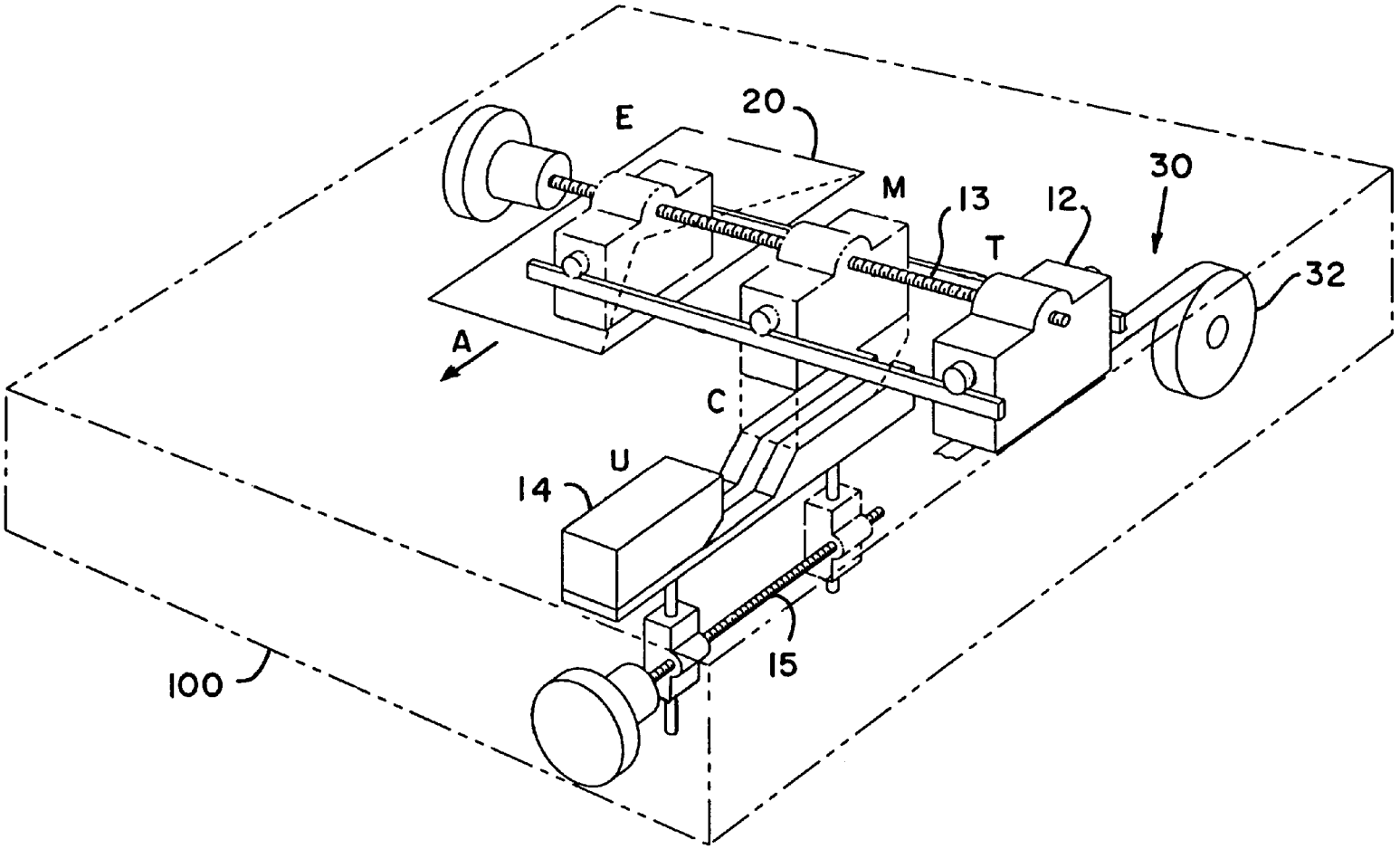
FIG. 2 is a simplified schematic of a perspective view of a printer module in accordance with the present invention.
Figure 3:
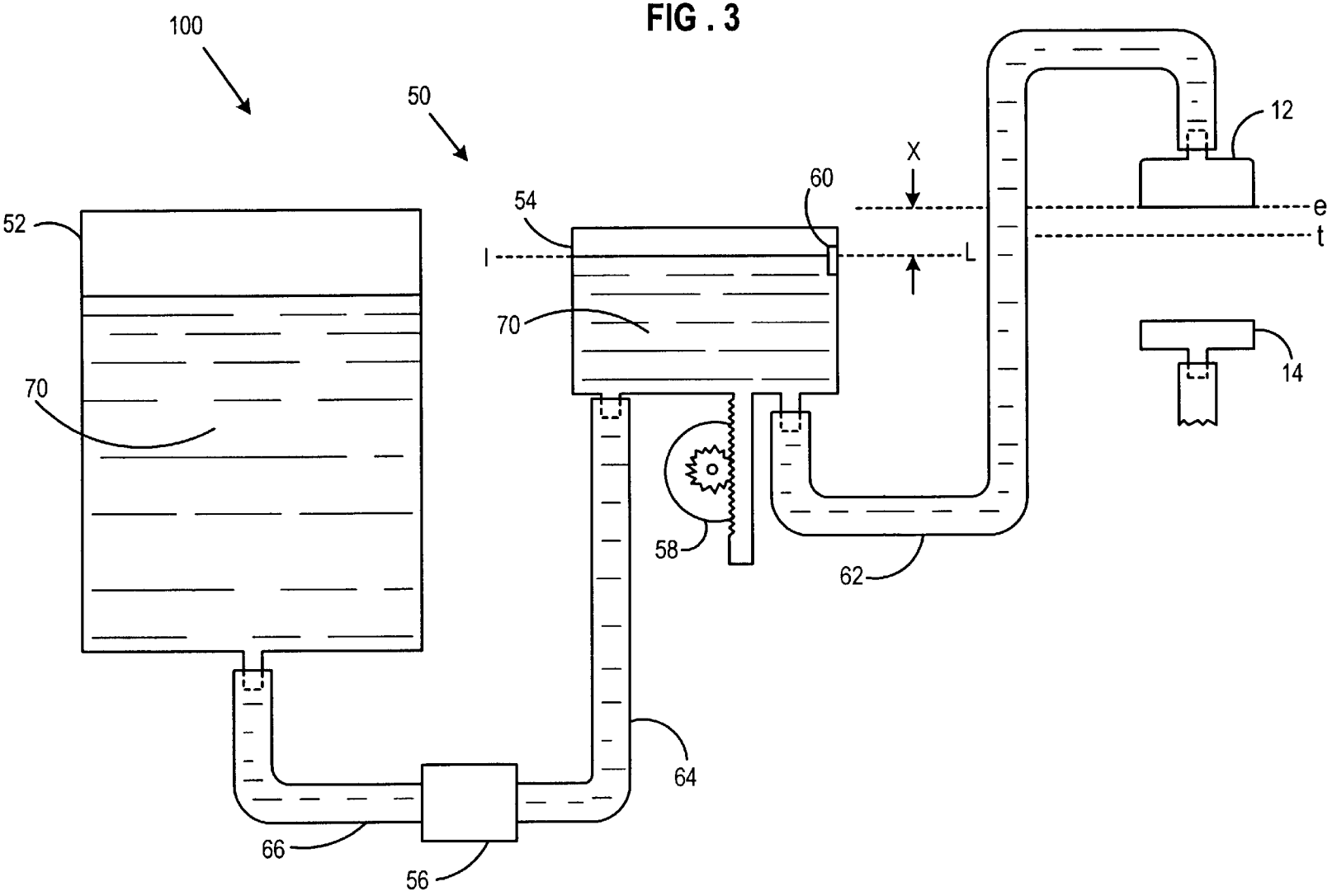
FIG. 3 is a simplified schematic of a front elevational view of an ink delivery system in accordance with the present invention.

Referring to FIG. 2, a more detailed view of the printer module 100 is provided. The printer module 100 includes: an ink jet print head 12, an ink jet maintenance station 14 for servicing and cleaning the print head 12, and an ink delivery system (not shown) and suitable framework (not shown) for supporting the various components of the printer module 100. The print head 12 is used for printing a postage indicia on the envelope 20 as the envelope 20 is fed in the path of travel as indicated by the arrow A. For the sake of clarity, the ink delivery system is not shown in FIG. 2, but is shown in FIG. 3 and described in detail below.

The mailing machine 10 further includes a tape system 30 including a roll of tape 32. Those skilled in the art will appreciate that any suitable tape system 30 for feeding either roll tape or strip tape may be employed. Therefore, no further description of the tape system 30 is necessary for an understanding of the present invention.

The print head 12 is translatable along a lead screw 13 arranged substantially transverse to the path of travel and can be stopped in one of three positions T, M and E. In FIG. 2, the print head 12 is shown in solid lines at position T and in dashed lines in positions M and E. In position E, the print head 12 is located proximate to the path of travel of the envelope 20 so that the postal indicia may be printed thereon. In analogous fashion, in position T the print head 12 is located proximate to the path of travel of the tape 32 so that the postal indicia may be printed thereon. In position M, the print head is located in a maintenance position and engaged with the maintenance station 14.

Similarly, the maintenance station 14 is translatable along a lead screw 15 arranged substantially parallel to the path of travel and can be stopped in one of two positions C and U. In FIG. 2, the maintenance station 14 is shown in solid lines at position U and in dashed lines in position C. In position C, the maintenance station 14 is engaged with the print head 12 so as to seal or cap the print head 12 off from ambient air. Generally, when not in use, the print head 12 is located in position M while the maintenance station 14 is located in position C. In position U, the maintenance station 14 is uncapped from the print head 12.

To produce a quality printed image, it is important to provide a fixed print gap between the print head 12 and the print medium (either the envelope 20 or the tape 32). In this way, the ink drops (not shown) reach the paper in a controlled manner. Due to various design requirements, the tilted deck 240 and inherent differences in feeding the envelope 20 and the tape 32, the vertical elevation of the print head 12 in position E and in position T is not the same even though the print gap is the same in both positions. Generally, the lead screw 13 is tilted at the same angle as the feed deck 240.

A more detailed description of the printer module 100 may be found in U.S. patent application Ser. No. 08/786,383 entitled INK JET PRINTER HAVING PRINT HEAD AND MAINTENANCE SYSTEM ALIGNMENT, filed on Jan. 16, 1997 and assigned to the assignee of the present invention, the disclosure of which is specifically incorporated herein by reference.

Referring to FIG. 3, the ink delivery system 50, located remotely from the print head 12, is shown. The ink delivery system 50 includes a main ink tank 52, a subsidiary ink tank 54, a pump 56, a motor 58, a series of connecting tubes and a sensor 60. The subsidiary ink tank 54 is slideably mounted to any suitable structure within the printer module 100 in conventional fashion. A tube 62 connects the subsidiary ink tank 54 to the print head 12 and is of sufficient length to accommodate the repositioning of the print head between print position E and print position T. The vertical elevation of position E is indicated by the dashed line e while the vertical elevation of position T is indicated by the dashed line t. Thus, the print head 12 is shown in the print position E while the maintenance station 14 is shown in the uncapped position U.

The subsidiary ink tank 54 is open to the atmosphere at the top and supplies ink 70 to the print head 12 via capillary action. The subsidiary ink tank 54 includes an ink sensor 60 for determining whether or not the ink 70 is at a desired level L. Generally, the sensor 60 may employ any conventional technology, such as: measuring change in thermal conductivity or measuring change in optical density.

The main tank 52 is detachably mounted to any suitable structure within the printer module 100 in conventional fashion. When the main tank 52 has exhausted its supply of ink 70, it may be refilled or replaced by the operator. The main tank 52 is connected to the subsidiary ink tank 54 via a pair of tubes 64 and 66 and a pump 56. When the pump 56 is activated, ink 70 is supplied from the main tank 52 to the subsidiary ink tank 54. When not in use, the pump 56 prevents ink 70 from flowing backward from the subsidiary ink tank 54 to the main tank 52.

With the structure of the mailing machine 10 described as above, the operational characteristics will now be described with reference to FIGS. 1, 2 and 3. Generally, the print head 12, the pump 56, the motor 58 and the sensor 60 are in communication with and under the control of the printer controller 320. When ink 70 is consumed by the print head 12 during printing, the level of ink 70 in the subsidiary ink tank 54 decreases. When the sensor 60 determines that the ink 70 is no longer at the desired level L, the pump 56 is instructed to supply ink 70 from the main tank 52 to subsidiary tank 54 until the ink 70 is again at the desired level L. Thus, the ink 70 is maintained fairly constant at the desired level L.

The subsidiary ink tank 54 is raised or lowered depending upon the position of the print head 12. The motor 58 is operatively coupled to the subsidiary ink tank 54 in any conventional fashion, such as by a pinion gear mounted on the output shaft of the motor 58 and a rack gear fixably attached to the subsidiary ink tank 54. By selectively energizing the motor 58, the subsidiary ink tank 54 may be repositioned vertically within the printer module 100. As shown in FIG. 3, the print head 12 is in position E while the subsidiary ink tank 54 is in a corresponding position to achieve a predetermined vertical distance X between the nozzle surface of the print head 12 and the predetermined level L of ink 70. Those skilled in the art will appreciate that the predetermined vertical distance X is selected to produce a desired back pressure at the print head 12. When the print head 12 is in position T, the subsidiary ink tank 54 is repositioned so as to maintain the same predetermined vertical distance X between the nozzle surface of the print head 12 and the predetermined level L of ink 70. Thus, the desired back pressure is maintained regardless of the position of the print head 12.

Those skilled in the art will now recognize that the present invention substantially solves those drawbacks associated with the prior art. For example, the off print head ink supply and delivery system 50 provides for greater ink capacity and reduces the mass on the print head 12 where space is at a premium. Thus, the main tank 52 and the subsidiary tank 54 may be located in a more convenient place within the mailing machine 10. As another example, by repositioning the subsidiary tank 54 depending upon the print positions E and T of the print head 12, accommodations are made for the differences in elevation between the print positions E and T while maintaining the desired back pressure at the print head 12.

In a second embodiment, a stationary subsidiary tank 54 may be employed if the sensor 60 is replaced with a vertical sensor array that can sense the level of the ink 70 throughout the subsidiary tank 54. Then, the pump 56 may be run in two directions, both supplying and removing ink 70, from the subsidiary tank 54 as necessary to adjust the level of ink 70 within the subsidiary tank 54 itself according to the print position of the print head 12. All that matters is that the level of ink 70 is adjusted, this may be achieved by raising and lowering the subsidiary tank 54 as discussed above, or by pumping ink 70 into and out of the subsidiary tank 54.

Many features of the preferred embodiment represent design choices selected to best exploit the inventive concept as implemented in a mailing machine. However, those skilled in the art will recognize that various modifications can be made without departing from the spirit of the present invention.

Therefore, the inventive concept in its broader aspects is not limited to the specific details of the preferred embodiments but is defined by the appended claims and their equivalents.

What is claimed is:

1. An ink jet printing system, comprising:

a print head translatable between a first print position having a first elevation and a second print position having a second elevation;

a tank containing a supply of ink having an ink level, the tank being operatively coupled with the print head for supplying ink to the print head, the tank being remotely located from the print head; and means for adjusting the ink level depending upon whether or not the print head is in the first print position or the second print position so that a predetermined back pressure is maintained at the print head in both the first print position and the second print position.

2. The ink jet printing system of claim 1, wherein:

the tank is slidably mounted within the ink jet printing system so that the tank is vertically repositionable; and the means for adjusting the ink level includes a mechanism operatively connected to the tank for repositioning the tank so that the predetermined back pressure is maintained.

3. The ink jet printing system of claim 2, further comprising:

a sensor mounted within the tank for determining whether or not the supply of ink is at a desired ink level within the tank;

a main tank containing a main supply of ink operatively coupled with the tank; and means for transferring ink from the main tank to the tank when the sensor determines that the supply of ink is below the desired level; and wherein:

the mechanism for repositioning the tank positions the tank in a first tank position when the print head is in the first print position and in a second tank position when the print head is in the second print position.

4. A method of operating an ink jet printing system, comprising the step(s) of:

providing a print head translatable between a first print position having a first elevation and a second print position having a second elevation;

providing a tank containing a supply of ink having an ink level, the tank being operatively coupled with the print head for supplying ink to the print head, the tank being remotely located from the print head; and adjusting the ink level depending upon whether or not the print head is in the first print position or the second print position so that a predetermined back pressure is maintained at the print head in both the first print position and the second print position.

5. The method of claim 4, wherein:

the tank is slidably mounted within the ink jet printing system so that the tank is vertically repositionable; and the means for adjusting the ink level includes a mechanism operatively connected to the tank for repositioning the tank so that the predetermined back pressure is maintained.

6. The method of claim 5, further comprising the step(s) of:

determining whether or not the supply of ink is at a desired ink level within the tank;

providing a main tank containing a main supply of ink operatively coupled with the tank;

transferring ink from the main tank to the tank when the supply of ink is below the desired level;

positioning the tank in a first tank position when the print head is in the first print position; and positioning the tank in a second tank position when the print head is in the second print position.

* * * * *